US008362984B2

(12) United States Patent
Le Roy et al.

(10) Patent No.: US 8,362,984 B2
(45) Date of Patent: Jan. 29, 2013

(54) METHOD FOR CONTROLLING A DISPLAY PANEL BY CAPACITIVE COUPLING

(75) Inventors: Philippe Le Roy, Betton (FR); Arnaud Trochet, Rennes (FR); Sylvain Thiebaud, Noyal sur Vilaine (FR)

(73) Assignee: Thomson Licensing, Issy les Moulineaux (FR)

( * ) Notice: Subject to any disclaimer, the term of this patent is extended or adjusted under 35 U.S.C. 154(b) by 942 days.

(21) Appl. No.: 12/086,731

(22) PCT Filed: Dec. 19, 2006

(86) PCT No.: PCT/EP2006/069924
§ 371 (c)(1),
(2), (4) Date: Jun. 18, 2008

(87) PCT Pub. No.: WO2007/071680
PCT Pub. Date: Jun. 28, 2007

(65) Prior Publication Data

US 2009/0015575 A1 Jan. 15, 2009

(30) Foreign Application Priority Data

Dec. 20, 2005 (FR) ..... 05 53978

(51) Int. Cl.
*G09G 3/32* (2006.01)

(52) U.S. Cl. ..... 345/82; 345/204

(58) Field of Classification Search ..... 345/204–209, 345/82–84
See application file for complete search history.

(56) References Cited

U.S. PATENT DOCUMENTS

| | | | | |
|---|---|---|---|---|
| 6,229,506 | B1 * | 5/2001 | Dawson et al. | 345/82 |
| 6,618,030 | B2 | 9/2003 | Kane et al. | |
| 6,777,888 | B2 | 8/2004 | Kondo | |
| 6,841,948 | B2 * | 1/2005 | Yoshida | 315/169.3 |
| 6,885,029 | B2 | 4/2005 | Miyazawa | |
| 7,193,589 | B2 | 3/2007 | Toshida et al. | |
| 7,551,164 | B2 * | 6/2009 | Deane | 345/204 |
| 2001/0024186 | A1 | 9/2001 | Kane et al. | |
| 2003/0052614 | A1 | 3/2003 | Howard | |
| 2003/0112205 | A1 | 6/2003 | Yamada | |
| 2005/0052366 | A1 | 3/2005 | Kim | |
| 2005/0052367 | A1 * | 3/2005 | Miyazawa | 345/76 |
| 2009/0009504 | A1 * | 1/2009 | Thiebaud et al. | 345/212 |
| 2010/0020056 | A1 * | 1/2010 | Le Roy et al. | 345/211 |

FOREIGN PATENT DOCUMENTS

| | | | |
|---|---|---|---|
| EP | 1094438 | A1 | 4/2001 |
| EP | 1197943 | A2 | 4/2002 |
| EP | 1517290 | A2 | 3/2005 |
| JP | 2004157467 | | 6/2004 |
| JP | 2005099773 | | 4/2005 |
| WO | WO2005071648 | A1 | 8/2005 |
| WO | WO2005073948 | A1 | 8/2005 |

OTHER PUBLICATIONS

Search Report Dated Apr. 10, 2007.

* cited by examiner

*Primary Examiner* — Liliana Cerullo
(74) *Attorney, Agent, or Firm* — Robert D. Shedd; Jeffrey M. Navon

(57) ABSTRACT

A method comprising emission periods during which a predetermined emission voltage, which presents a first polarity, is applied and sustained at the control terminal of at least one driver of said panel, and depolarization periods during which a predetermined depolarization voltage, which presents a second polarity, opposite to the first polarity, is applied and sustained at the control terminal of at least one driver of said panel, the address signals of the circuits of said panel being transmitted by capacitive coupling of the address electrodes to the control terminals of these circuits. The invention makes it possible to use conventional and inexpensive means of controlling the address electrodes.

6 Claims, 2 Drawing Sheets

METHOD FOR CONTROLLING A DISPLAY PANEL BY CAPACITIVE COUPLING

Figure 1:
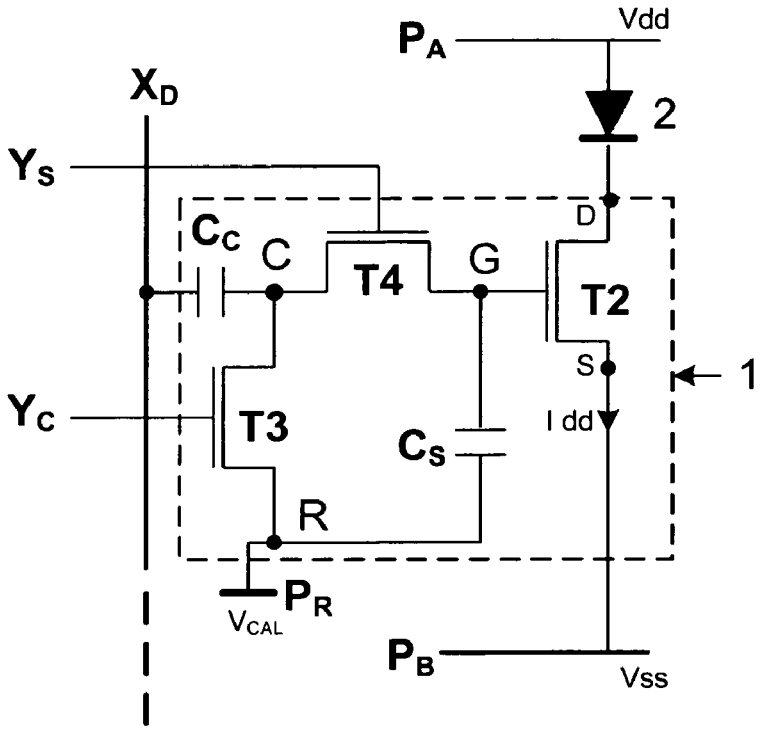

This application claims the benefit, under 35 U.S.C. §365 of International Application PCT/EP2006/069924, filed Dec. 19, 2006, which was published in accordance with PCT Article 21(2) on Jun. 28, 2007 in French and which claims the benefit of French patent application No. 0553978, filed Dec. 20, 2005.

The invention relates to active matrix panels that can be used to display images using arrays of light emitters, for example light-emitting diodes, or arrays of optical valves, for example liquid crystal valves. These emitters or these valves are normally divided up into rows and columns.

The term "active matrix" denotes a substrate which integrates arrays of electrodes and circuits suitable for controlling and supplying power to the emitters or optical valves supported by this substrate. These arrays of electrodes normally comprise at least one array of address electrodes, one array of select electrodes, at least one reference electrode for addressing and at least one base electrode for supplying power to these emitters. Sometimes, the reference electrode for addressing and the base electrode for power supply are combined. The panel also comprises at least one upper power supply electrode, normally common to all the valves or to all the emitters, but which is not integrated in the active matrix. Each valve or emitter is normally inserted between a base power supply terminal linked to a base electrode for the power supply and the upper power supply electrode which normally covers all the panel.

Each control circuit (or "driver") comprises a control terminal linked or coupled to an address electrode via a select switch, a select terminal which corresponds to the control of this switch and which is linked to a select electrode, and a reference terminal linked or coupled to a reference electrode.

Each driver therefore comprises a select switch suitable for transmitting to this circuit the address signals originating from an address electrode. The closure of the select switch of a circuit corresponds to the selection of that circuit.

Generally, each address electrode is linked or coupled to the control terminals of the drivers of all the emitters or of all the valves of one and the same column; each select electrode is linked to the select terminals of the drivers of all the emitters or of all the valves of one and the same row. The active matrix can also comprise other row or column electrodes.

The address electrodes are used to address to the drivers control signals, voltage- or current-mode analogue, or digital; during the emission periods, each control signal intended for the driver of a valve or of an emitter is representative of an image datum of a pixel or sub-pixel associated with that valve or that emitter.

In the case of a panel of optical valves, each driver and power supply circuit comprises a memory element, normally a capacitor designed to sustain the control voltage of that valve for the duration of an image frame; this capacitor is connected in parallel directly to this valve. The control voltage of a valve is the potential difference at the terminals of that valve. In a particularly simple driver case, the control terminal of the circuit is linked or coupled to one of the terminals of the valve.

In the case of a panel of current-controllable emitters, for example of light-emitting diodes, in particular of organic diodes, each driver and power supply circuit normally comprises a current modulator, normally a TFT transistor, provided with two current-passing terminals, one source terminal and one drain terminal, and a gate terminal for voltage-mode control; this modulator is then connected in series with the emitter to be controlled, this series being in turn connected between an (upper) power supply electrode and a base electrode for the power supply, normally, it is the drain terminal which is common to the modulator and to the emitter, and the source terminal, linked to the base electrode for the power supply, is thus at a constant potential; the control voltage of the modulator is the potential difference between the gate and the source of the modulator; each driver comprises means for generating a control voltage of the modulator according to the signal addressed to the control terminal of that circuit; each driver also comprises, as previously, a sustain capacitor designed to sustain the control voltage of the modulator for the duration of each image or image frame. In a particularly simple driver case, the control terminal of the circuit corresponds to the gate terminal of the modulator. Conventionally, there are two types of control: voltage-mode control or current-mode control. In the case of a voltage-mode control, the address signals are voltage steps; in the case of current-mode control, the address signals are current steps.

In the case of current-mode control of emitter panels, each driver is designed in a way known per se to "program", based on a current signal, a control voltage of the modulator of this circuit, which is therefore applied to the gate terminal.

The address electrodes and the select electrodes are in turn controlled by control means ("electrode drivers") placed at the ends of these electrodes, at the edge of the panel; these means normally comprise controllable switches. To ensure a good display quality of the images and/or to improve the life of the panel, it is important to regularly reverse the control voltage of the modulators of the drivers, and/or the power supply voltage of the valves or the emitters:

- in the case of panels of optical valves, in particular of liquid crystals, the voltage is normally alternated at the terminals of the valves to avoid initiating a direct liquid crystal polarization component;
- in the case of panels of light emitters, where the emitters are light-emitting diodes, it may be advantageous to regularly reverse the voltage at the terminals of the emitters, as described, for example, in documents EP1094438 and EP1197943; however, during the periods when this power supply voltage is reversed, these emitters obviously emit no light, the diodes then being polarized in the reverse direction;
- in the case of panels of current-controllable emitters, the drivers of which comprise a current modulator, where these modulators are transistors comprising active layers of amorphous silicon, it may be advantageous to regularly reverse the control voltage of the modulators, in particular to compensate for the trigger threshold voltage drifts of this type of transistor: documents US2003/052614, WO2005/071648 illustrate such a situation. When images are displayed, there are then distinguished, for each driver, display or emission periods, where the sign of this voltage is adapted to render the modulator passing, and so-called depolarization periods, when the sign of this voltage is reversed and does not allow the modulator to be rendered passing. For the overall control of the panel, the emission periods and the depolarization periods can overlap: while the emitters or valves of certain rows emit light, the circuits, emitters or valves of other rows can be being depolarized.

Nevertheless, overall, the alternation of these periods is prejudicial to the maximum luminance of the panel, since the overall time available for emission from the emitters is reduced by the duration of the depolarization periods. Still in the case of panels of current-controllable emitters, in order to avoid this reduction in luminance, document WO2005/073948 proposes a panel in which each emitter is provided with two drivers and is controlled alternately by one and by the other, and which entails duplicating the array of address electrodes. Other solutions, conversely, entail adding an array of row electrodes.

Document US2003/112205 describes a specific solution: by controlling the driver described in FIG. 6 as indicated in paragraphs 44 and 45 of this document, where a negative voltage Vee is applied to the reference address electrode (which is also the base electrode for the power supply), during the so-called "non-luminescence" periods, there is then obtained a reverse polarization at the terminals of the emitter (in this case, a light-emitting diode), and, during this reverse polarization, the control of the current modulator Tr2 which is in series with this emitter is cancelled (source and gate of this modulator are at the same potential because of the closure of the switch short-circuiting the sustain capacitor).

By using the solutions described in the documents US2003/052614, WO2005/071648, the means of controlling the address electrodes need to be adapted to transmit address signals of opposite signs or polarity; the solution described in document US2003/052614 entails adding a "toggle" element at the head of each address electrode; this adaptation condition entails a significant cost overhead in column "drivers".

One object of the invention is to avoid this drawback.

In the prior art, the address signals are normally transmitted to the drivers by direct conduction between the address electrodes and the control terminals of the circuits, via the select switch: in the case of the analogue voltage-mode control of panels of emitters, where the control terminal of the circuit corresponds to the gate terminal of the modulator, this gate voltage of the modulator is then equal to the voltage of the address electrode that controls this circuit, at least while this circuit is selected.

Document U.S. Pat. No. 6,229,506 describes the case where these address signals are, on the contrary, transmitted to the drivers by capacitive coupling: in the case of the voltage-mode control (FIGS. 3 and 4 in this document), a coupling capacitance (respectively referenced 350 and 450) here provides the direct link without conduction between the address electrode and the control terminal of the circuit. When such a circuit is selected, this arrangement makes it possible to add the voltage jump signal originating from the address electrode to a modulator trigger threshold voltage, previously stored in the circuit. The link by capacitive coupling, and not by conduction, between the address electrodes and the control terminals of the circuits in this case makes it possible to compensate the trigger threshold differences of the modulators of these circuits, so as to obtain a more uniform luminance of the screen and a better image display quality. To the same end, the other documents U.S. Pat. No. 6,777,888, U.S. Pat. No. 6,618,030, U.S. Pat. No. 6,885,029 describe a capacitive coupling between the address electrodes and the control of the current modulators of the emitters.

An essential aspect of the invention consists in using such a capacitive coupling for another purpose, namely in order to reverse the voltages at the valve terminals or at the emitter terminals, or the control voltages of the modulators of the drivers of these emitters, without having to reverse the address signals, which avoids the need for costly address electrode control means.

Thus, according to the invention, the voltage signal that is transmitted by capacitive coupling is, in particular, an address signal for the emission, which is representative of an image datum and/or an address signal (of the same sign) for the depolarization, in particular for the depolarization of the current modulator of an emitter.

As a general rule, capacitive coupling makes it possible to modify the voltage of a terminal by a voltage jump. Thus, a voltage step signal of algebraic value $\Delta V$ transmitted via capacitive coupling by an address electrode to a control terminal previously at the potential $V_{cal}$, changes the potential of that terminal from V to $V_{cal}+\Delta V$. This voltage jump is independent of the value $V_{ini}$ of the initial potential (before the jump) of the address electrode.

When the desire is for the potential of the control terminal of a circuit to reduce by a value $\Delta V$ ($\Delta V<0$) from an initial value $V_{cal}$ to the point of achieving a potential $V_{cal}+\Delta V$ of reverse sign of that that is applied to obtain the emission from the emitter controlled by this circuit, through the capacitive coupling, it is enough, according to the invention, for the initial value $V_{ini}$ (eg: $V_{ini}>0$) of the potential of the address electrode coupled to this terminal to be high enough for the algebraic sum $V_{ini}+\Delta V$ ($\Delta V<0$) to keep the same sign as $V_{ini}$, and therefore to choose $|V_{ini}|>|\Delta V|$.

For the implementation of the invention as described in detail below, the control of each driver of an emitter comprises, when displaying each image frame, two periods, a period of emission from this emitter and a period of depolarization of the modulator of the driver of this emitter.

For the implementation of the invention as described below in detail, in each control period of a circuit, at least of depolarization, if not also of emission:

1/this circuit is selected by capacitively coupling the control terminal of this circuit to an address electrode and the potential of this terminal is "clamped" to the potential $V_{cal}$ of a reference terminal, which therefore becomes a "clamping terminal" of this circuit; during this selection and this "clamping", a potential $V_{ini}$ is applied to the address electrode, with no effect other than transient, because of this clamping, on the potential of the control terminal which remains at the value $V_{cal}$;

2/with the circuit still being selected but the control terminal no longer being clamp to the clamping terminal, there is applied to the address electrode a voltage jump signal $\Delta V$ which is passed on by the capacitive coupling to the control terminal, which thus switches from the potential $V_{cal}$ to the potential $V_{prog}=V_{cal}+\Delta V$.

During the rest of the current (emission or depolarization) period, the potential of the control terminal is maintained at this value by the sustain capacitor, as in the prior art.

It can thus be seen that the value of $V_{ini}$ has no impact on the potential of the control terminal. According to the invention, in the voltage reversal or depolarization periods, the value of $V_{ini}$ is therefore adapted so that $|V_{ini}|=|\Delta V|$ in order for the signal to be applied to the address electrode to obtain $V_{prog}$ on the control terminal not to change sign. Thus, advantageously, the need for costly address electrode control means is avoided.

The same principle can be applied in order to reverse the voltages at the valve terminals or at the emitter terminals, without having to reverse the polarity between the power supply electrodes.

The control method specific to the invention can be used either only during the depolarization periods—and a conventional addressing by conduction is then used during the emission periods—during both the emission and the depolarization periods.

An advantage of this control method is that it makes it possible to address to each circuit a specific depolarization signal, and adapt the depolarization operation at the level of depolarization of the modulator of each circuit, a level that depends in particular on the emission signal addressed in the preceding emission period.

The subject of the invention is therefore a method of controlling a display panel which comprises:

an array of light emitters or optical valves, an active matrix comprising an array of electrodes for addressing voltage-mode signals, an array of select electrodes, an array of clamping electrodes, at least one reference electrode for addressing, an array of circuits suitable for controlling each of said emitters or valves and each provided with a voltage-mode control terminal suitable for coupling to an address electrode via a coupling capacitor and a select switch which are mounted in series, a voltage-mode clamping terminal suitable for connecting to said control terminal via a clamping switch and a sustain capacitor mounted between said control terminal and said clamping terminal, the clamping terminal being linked to the at least one reference electrode, the control of said select switch being linked to a select electrode and the control of said clamping switch being linked to a clamping electrode, said method comprising emission periods during which a predetermined emission voltage $V_{prog\text{-}data}$, which presents a first polarity, is applied and sustained at the control terminal of at least one driver of said panel, where this method also comprises depolarization periods during which a predetermined depolarization voltage $V_{prog\text{-}pol}$, which presents a second polarity, opposite to the first polarity, is applied and sustained at the control terminal of at least one driver of said panel.

The emitters or valves are suitable to be powered between at least two power supply electrodes, namely a base electrode for the power supply that is normally part of the active matrix, and a so-called "upper" power supply electrode, which normally covers all the emitters or valves.

The sustain capacitor is suitable to sustain an approximately constant voltage on said control terminal for the duration of an image when said first select switch and said clamping switch are open.

Switches other than the clamping switch, in particular the select switch itself, can be used to link the voltage-mode clamping terminal to the control terminal. In practice, during emission or depolarization periods, a predetermined emission or depolarization voltage is normally applied and sustained at the control terminal of each of said drivers of said panel.

Preferably, said predetermined emission voltage $V_{prog\text{-}data}$ or depolarization voltage $V_{prog\text{-}pol}$ is applied to the control terminal of the at least one driver by capacitive coupling according to the following steps:

a clamping step, during which, said reference electrode of the panel being raised to a clamping potential, a select signal is applied to the select electrode that controls the select switch and a clamping signal is applied to the clamping electrode that controls the clamping switch of said driver, these signals being suitable for closing said switches, and, while said select signal and said clamping signal are being applied simultaneously, an initial voltage signal $V_{ini\text{-}E}$, $V_{ini\text{-}P}$ is applied to the address electrode to which said control terminal is suitable to be coupled, a circuit addressing step, during which, having ended said clamping signal but while sustaining said select signal, after the clamping of the potential of the control terminal to the clamping potential $V_{cal}$ of the clamping terminal linked to said reference electrode has been obtained and after the application of said initial signal, a final voltage signal $V_{data}$, $V_{pol}$ is applied to said address electrode, this final signal generating a voltage jump $\Delta V_{data}=V_{data}-V_{ini\text{-}E}$, $\Delta V_{pol}=V_{pol}-V_{ini\text{-}P}$ on this address electrode which in turn generates a voltage jump $\Delta V_{prog\text{-}data}=V_{prog\text{-}data}-V_{cal}$, $\Delta V_{prog\text{-}pol}=V_{prog\text{-}pol}-V_{cal}$ on said control terminal that is coupled to said address electrode, the values of said initial signal $V_{ini\text{-}E}$, $V_{ini\text{-}P}$ and of said final signal $V_{data}$, $V_{pol}$ being adapted to obtain, after said voltage jump on said control terminal, said predetermined voltage $V_{prog\text{-}data}$, $V_{prog\text{-}pol}$.

The panel is normally intended to display a succession (or sequence) of images; each emitter or valve of the panel then has a corresponding pixel or sub-pixel of the images to be displayed; during each emission period, each emitter or valve of the panel has associated with it a predetermined emission voltage to control this emitter or valve, this voltage being adapted to obtain the display of said pixel or sub-pixel by this emitter or valve; during each depolarization period, each emitter or valve of the panel has associated with it a predetermined depolarization voltage suitable for depolarizing this emitter, this valve, and/or its driver.

Thus, the predetermined voltage to be applied and sustained at the control terminal of the drivers of said panel is intended:

for the emitter or the valve of the panel that is controlled by this circuit to emit a pixel or a sub-pixel of the image to be displayed, and/or for the emitter or the valve of the panel, or the driver, or, where appropriate, the current modulator of this circuit, to be depolarized, at least partially.

After the addressing step, the select signal is ended, which causes the select switch of the driver to be opened. At this instant, the voltage of the control terminal is therefore equal to said predetermined voltage, and is maintained approximately at this value for the rest of the duration of the period thanks to the sustain capacitor to which this terminal is connected.

The duly obtained said predetermined voltage at the control terminal results from a voltage jump provoked at this terminal by capacitive coupling to the address electrode which is itself subject to a voltage jump; from this predetermined voltage, it is possible to deduce the voltage jump to be obtained at the control terminal by difference with the potential of the reference electrode to which this terminal has previously been clamped; from this voltage jump to be obtained at the control terminal, it is possible to deduce the voltage jump to be generated at the address electrode, according, in particular, to the level of coupling with the control terminal.

Preferably, whatever the emission or depolarization period, and the polarity of said predetermined emission voltage $V_{prog\text{-}data}$ or of said predetermined depolarization voltage $V_{prog\text{-}pol}$, said initial voltage signal $V_{ini\text{-}P}$ and said final voltage signal $V_{pol}$ are chosen such that said signals both present the same first polarity.

In practice, for example for a depolarization period and a predetermined depolarization voltage $V_{prog\text{-}pol}$ to be applied to the control terminal (C) of a driver, the difference $\Delta V_{pol}=V_{pol}-V_{ini\text{-}P}$ adapted to obtain this depolarization voltage $V_{prog\text{-}pol}$ is chosen first; then, a sufficiently high value of $V_{ini\text{-}P}$ presenting the first polarity is chosen, for the value of $V_{pol\text{-}1}$, devolving from said difference $\Delta V_{pol}$, to also present the first polarity. Preferably, when the value of $\Delta V_{pol}$ permits it, $V_{ini\text{-}P}=0$ is chosen.

The polarity of the signals is evaluated relative to a reference electrode for the control voltage of the circuits; it can be, in particular, a base electrode for the power supply to the emitters or the valves.

Thus, the voltage of the address electrode never changes sign and, advantageously, conventional and inexpensive means for controlling the address electrodes can be used.

Preferably, said panel comprises an array of light emitters suitable to be powered between at least one base power supply electrode and at least one upper power supply electrode, and each of said drivers of an emitter comprises a current modulator comprising a voltage-mode control electrode forming the control electrode of said circuit and two current-passing electrodes, which are connected between one of said power supply electrodes and a power supply electrode of said emitter. Normally, such a modulator is a TFT transistor; the current delivered by the modulator is then dependent on the potential difference between the gate terminal and the source terminal of this transistor; this potential difference is normally a function of, if not equal to, the potential difference between the control terminal and a reference electrode for the control voltage of the circuit; the reference electrode for the control voltage of the circuit is then formed by the base power supply electrode.

Preferably, said current modulator is a transistor comprising a semiconductor layer of amorphous silicon.

Preferably, said emitters are light-emitting diodes, preferably organic.

Figure 2:
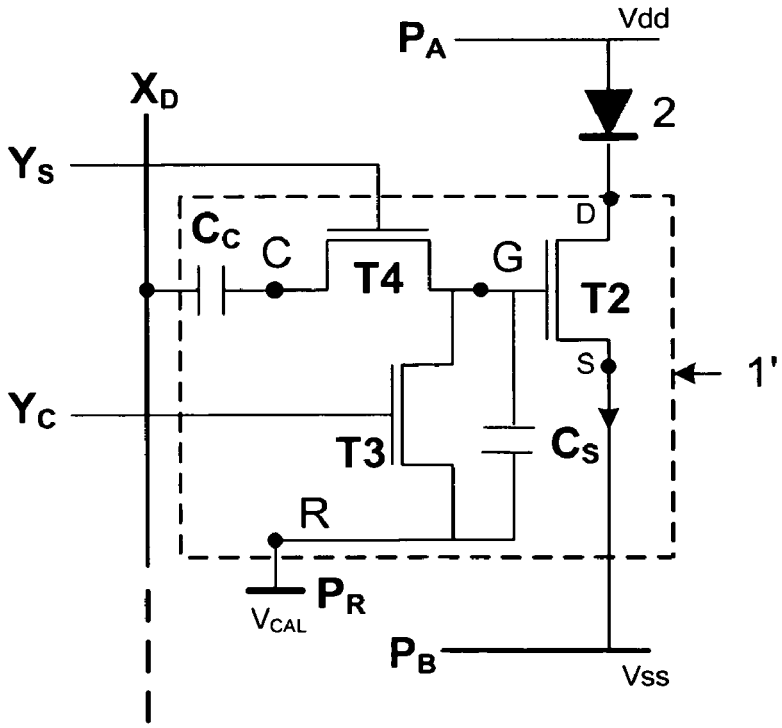
Figure 3:
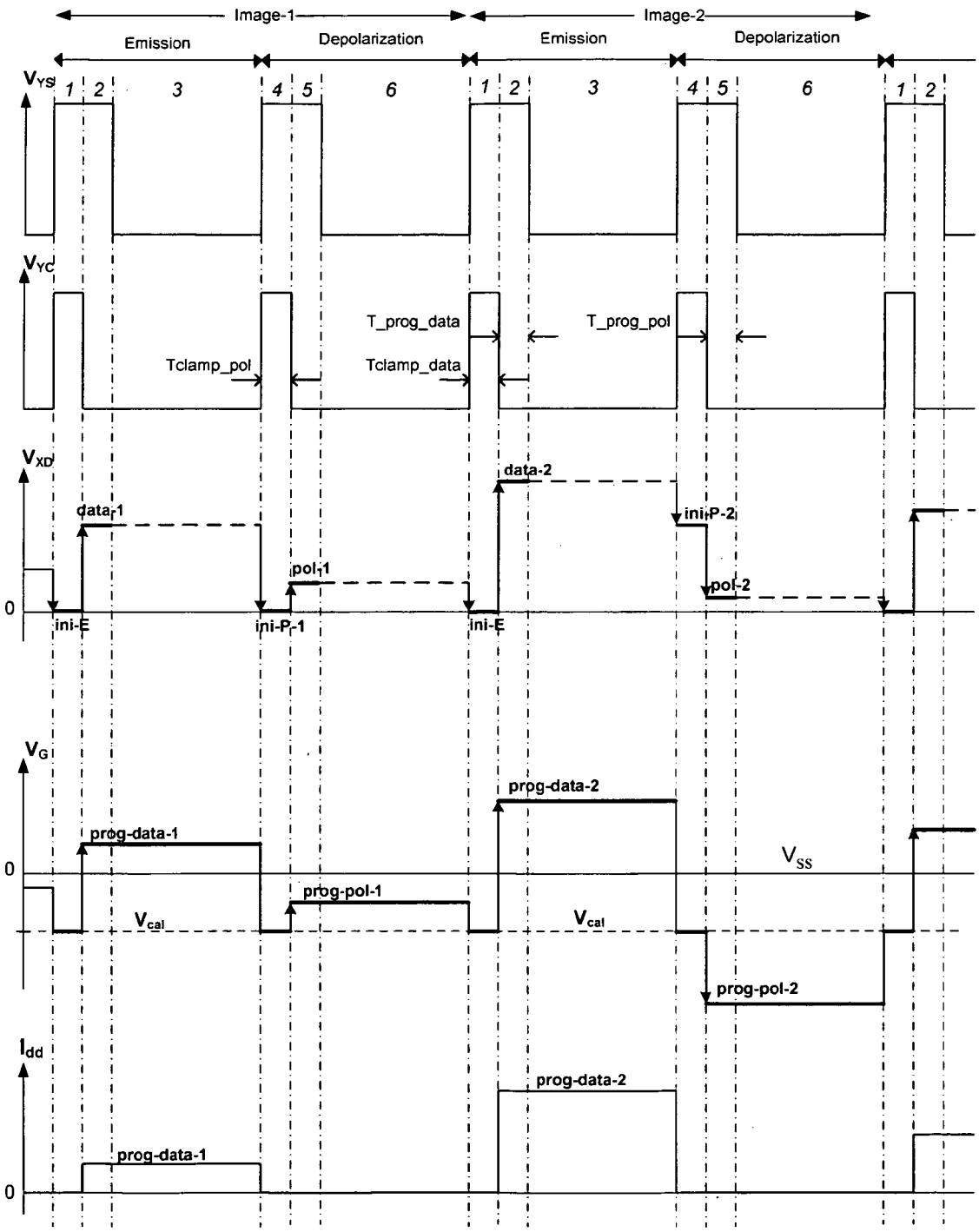

The invention will be better understood from reading the description that follows, given by way of non-limiting example and with reference to the appended figures, in which:

FIGS. 1 and 2 describe two embodiments of panel drivers according to the invention;

FIG. 3 is a timing diagram of the signals applied during a succession of periods and frames for the control of the circuit of FIG. 1 when controlling a panel according to the first method of the invention (logic signals $V_{YS}$, $V_{YC}$, address signals $V_{XD}$); this timing diagram also illustrates the trend of the control potential of the modulator $V_G$ of this circuit, and of the intensity $I_{dd}$ of the current circulating in the diode that is controlled by this circuit.

The figures representing timing diagrams do not take into account a scale of values, the better to show certain details that would not be clearly apparent if the proportions had been respected.

In order to simplify the description, identical references are used for those elements that handle the same functions.

The embodiments described below concern image display panels in which the emitters are organic light-emitting diodes deposited on an active matrix integrating driver and power supply circuits for these diodes. These emitters are arranged in rows and columns.

There now follows a description of a first embodiment of the invention where the panel comprises two arrays of electrodes arranged in rows, and where the drivers of the emitters each comprise only three TFT transistors, one forming a current modulator and the other two forming switches.

With reference to FIG. 1, which describes a driver and power supply circuit of a diode and its connections to the electrodes of the panel, the active matrix of the panel according to this first embodiment comprises:

- an array of address electrodes arranged in columns so that all the circuits controlling the diodes of one and the same column are served by the same address electrode $X_D$;
- an array of select electrodes $Y_S$ arranged in rows so that all the circuits controlling the diodes of one and the same row are served by the same electrode;
- an array of clamping control electrodes $Y_C$ arranged in rows so that all the circuits controlling the diodes of one and the same row are served by the same electrode;
- a reference electrode $P_R$ common to all the circuits;
- a base power supply electrode $P_B$ common to all the circuits.

The active matrix also comprises a driver and power supply circuit 1 for each diode 2.

The panel also comprises an upper power supply electrode $P_A$, common to all the diodes.

The driver and power supply circuit 1 of each diode 2 comprises:

- a current modulator T2 comprising two current terminals, namely a drain terminal D and a source terminal S, and a gate terminal G, which here corresponds to the control terminal C of the circuit.
- a sustain capacitor Cs connected between said gate G and a clamping terminal R of the circuit.

The control terminal C of the circuit is coupled to an address electrode $X_D$ via a select switch T4 and a coupling capacitor Cc, which are connected in series; here, there is no connection by electrical conduction between this control terminal C and this address electrode $X_D$. Preferably, this coupling capacitor $C_C$ is common to all the drivers served by this address electrode. The select switch T4 is controlled by a select electrode $Y_S$.

The circuit 1 also comprises a clamping switch T3 suitable to link, via the switch T4, the control terminal C to the clamping terminal R of the circuit; this clamping switch T3 is controlled by a clamping electrode $Y_C$. The clamping terminal R is linked to the reference electrode $P_R$.

The current modulator T2 is linked in series with the diode 2: the drain terminal D is thus connected to the cathode of the diode 2. This series is connected between two power supply electrodes: the source terminal S is connected to the base power supply electrode $P_B$ and the anode of the diode 2 is connected to the upper power supply electrode $P_A$.

With reference to FIG. 3, there now follows a description of the operation of the panel according to this first embodiment.

The potentials $V_{cal}$, Vdd and Vss are respectively applied to the reference electrode $P_R$, and the power supply electrodes $P_A$ and $P_B$. Here, the potential Vss of the base power supply electrode $P_B$ is zero and is used as a reference for the control voltage of the circuit, which here corresponds to the difference $V_G-V_S=V_G-Vss=V_G$. Other references for the control voltage of the circuit can be considered without departing from the spirit of the invention. The difference Vdd−Vss is adapted to obtain the emission from the diode when the control of the modulator is greater than its trigger threshold voltage. The value of $V_{cal}$ is normally negative (that is, less than the "0" level of the address signal) for reasons which will be described later.

As in the abovementioned prior art, at the level of each diode of the panel and its driver, each image frame is divided into an emission period from the emitter, for the display of the corresponding pixel or sub-pixel of this image, and a depolarization period, for compensating for the drift in the threshold of the modulator of this circuit.

For the control of each driver 1 of a diode 2, the duration of each image frame is then divided into six steps.

Step 1 for clamping the control of the modulator during the emission period: this step marks the start of the emission period of the diode in this image frame. The select switch T4 and the clamping switch T3 are closed simultaneously by respectively applying to the electrodes $Y_S$ and $Y_C$ an appropriate logic signal (see the first two timing diagrams of FIG. 3); the closure of T4 causes the driver 1 of the diode 2 (and the other circuits of the same row) to be selected by coupling, via the capacitor $C_C$, the control terminal C to the address electrode $X_D$; the simultaneous closure of the switches T3 and T4 also results, despite the capacitive coupling, in clamping the potential of the control terminal C to the clamping potential $V_{cal}$ applied to the reference electrode $P_R$, and thus in clamping the voltage of the gate G of the modulator T2; while the control terminal C is being clamped, the potential of the address electrode is raised to the value $V_{ini-E}=0$. The duration of this step is long enough to obtain the stabilization of the potentials, and in particular for the potential of the gate G to remain at the value $V_{cal}$.

Step 2 for addressing the circuit during the emission period:

The clamping switch T3 is then opened while maintaining the select switch T4 closed; during this time, the potential of the address electrode is raised to the value $V_{data-1}$ (and the potential of the other address electrodes to the values $V_{data-1}, \ldots, V_{data-i}, \ldots$). By capacitive coupling via the coupling capacitor $C_C$, the potential $V_G$ of the gate G is subject to a (positive) jump $\Delta V_{prog-data-1}$ proportional to $\Delta V_{data-1}=V_{data-1}-V_{ini-E}=V_{data-1}$, and thus switches from the value $V_{cal}$ to a positive value $V_{cal}+\Delta V_{prog-data-1}=V_{prog-data-1}$; the value of $V_{data-1}$ is established such that the control voltage of the modulator $V_G-V_S=V_{prog-data-1}-V_{ss}=V_{prog-data-1}$ is proportional to the image datum to be displayed by the diode 2 during this image frame, apart from a correction which will be described later. The duration of the step 2 is adapted in a manner known per se to obtain the stabilization of the potentials at these values and to charge the sustain capacitor $C_S$. At this stage, the diode 2 therefore starts to emit a luminance proportional, apart from said correction, to the image datum of the pixel or sub-pixel that is associated with it in this image frame.

Step 3 for maintaining the circuit during the emission period:

During the rest of the emission period of this diode 2 in this image frame, the select switch T4 is opened while the clamping switch T3 is maintained open; the driver 1 is therefore no longer selected and there is no more capacitive coupling between the address electrode $X_D$ and the control terminal C of the circuit 1. During this step, the capacitor $C_S$ sustains at a constant value the voltage of the control terminal C, and the diode 2 therefore continues to emit a luminance proportional to the image datum of the pixel or sub-pixel that is associated with it. It may be that the voltage of the control terminal C is subject to a slight drop $-\Delta V_{prog-data-cor}$ between the step 2 and the step 3 because of the elimination of the capacitive coupling; in order for the luminance of the diode to be correctly proportional to the image datum, it is preferable to apply a correction $+\Delta V_{prog-data-cor}$ to the value $V_{prog-data-1}$ aimed for in step 2.

During this step 3, the drivers of the other rows of diodes are selected and addressed by also applying to them the above steps 1 and 2; the panel then displays all of the image.

Step 4 for clamping the control of the modulator during the depolarization period: the start of this step marks the end of the emission period of the diode and the start of the depolarization period of the modulator T2.

The select switch T4 and the clamping switch T3 are simultaneously closed by respectively applying to the electrodes $Y_S$ and $Y_C$ an appropriate logic signal (see the first two timing diagrams of FIG. 3); the closure of T4 causes the driver 1 of the diode 2 to be selected by coupling, via the capacitor $C_C$, the control terminal C to the address electrode $X_D$; the simultaneous closure of the switches T3 and T4 causes, despite the capacitive coupling, the potential of the control terminal C to be clamped to the clamping potential $V_{cal}$ applied to the reference electrode $P_R$; while the control terminal C is being clamped, the potential of the address electrode is raised to the value $V_{ini-P-1}$, the value of which will be established later. The duration of this step is long enough to obtain the stabilization of the potentials, and in particular for the potential of the control terminal C to remain at the value $V_{cal}$.

Step 5 for addressing the circuit during the depolarization period:

The clamping switch T3 is then opened while maintaining the select switch T4 closed; during this time, the potential of the address electrode is raised to the value $V_{pol-1}$ less than $V_{data-1}$. By capacitive coupling via the coupling capacitor $C_C$, the voltage $V_G$ of the control terminal C is therefore subject to a voltage jump $\Delta V_{prog-pol-1}$ proportional to $\Delta V_{pol-1}=V_{pol-1}-V_{ini-P-1}$, and thus switches from the value $V_{cal}$ to a value: $V_{cal}+\Delta V_{prog-pol-1}=V_{prog-pol-1}$; according to the invention, the values of $V_{ini-P-1}$ and $V_{pol-1}$ are chosen according to a double criterion:

- criterion 1: the difference $\Delta V_{pol-1}$, in this case positive (but negative in the second image frame—see FIG. 3), is adapted, apart from a correction that will be described later, to obtain a (negative) depolarization control voltage of the modulator $V_G-V_S=V_{prog-pol-1}-Vss=V_{prog-pol-1}$ of appropriate value, in a manner known per se, to compensate for the drift of the trigger threshold voltage of the modulator which occurred during the preceding emission period;
- criterion 2: $V_{ini-P-1}$ is high enough for $V_{pol-1}$, defined according to the criterion 1, to be positive or zero. Preferably, when the value of $\Delta V_{pol-1}$ permits it, $V_{ini-P-1}=0$ is chosen, as FIG. 3 illustrates in the case of the first frame.

Thus, the voltage of the address electrode never changes sign and, advantageously, conventional and inexpensive means for controlling the address electrodes can be used.

The duration of the step 5 is adapted in a manner known per se to obtain the stabilization of the potentials at these values and to charge the sustain capacitor $C_S$. At this stage, the modulator T2 starts to be depolarized in proportion to the value of $V_{prog-pol-1}$.

Step 6 for maintaining the circuit during the depolarization period:

During the rest of the depolarization period of this diode 2 in this image frame, the select switch T4 is opened while the clamping switch T3 is maintained open; the driver 1 is therefore no longer selected and there is no more capacitive coupling between the address electrode $X_D$ and the control terminal C of the circuit 1. During this step, the capacitor $C_S$ sustains at a constant value the control voltage of the modulator T2, and the modulator T2 therefore continues to be depolarized in proportion to the value of $V_{prog-pol-1}$.

It may be that the control voltage of the modulator T2 is subject to a slight drop $-A\Delta V_{prog-pol-cor}$ between the step 4 and the step 5 because of the elimination of the capacitive coupling; in order for the depolarization of the modulator to conform to the objectives, it is then preferable to apply a correction $+\Delta V_{prog-pol-cor}$ to the value $V_{prog-pol-1}$ aimed for in the step 4.

During this step 6, the steps 4 and 5 are applied to the drivers of the other rows of diodes so as to depolarize the modulators of the circuits of the other rows; the depolarization of the modulators of all the panel is thus obtained.

The end of this step marks the end of the depolarization period of the modulator T2 and the start of a new emission period of the diode 2, in a new image frame. FIG. 3 represents the control timing diagrams of a driver 1 of an emitter 2 for two successive image frames.

As seen above, in the first frame, the potentials of the address electrode $X_D$ successively assume the values $V_{ini-E}=0$, $V_{data-1}$, $V_{ini-P-1}$, $V_{pol-1}$, and the potentials of the gate G of the modulator T2 successively assume the values $V_{cal}$, $V_{prog-data-1}$, $V_{cal}$, $V_{prog-pol-1}$, with $\Delta V_{data-1}=V_{data-1}-V_{ini-E}$, $\Delta V_{prog-data-1}=V_{prog-data-1}-V_{cal}$, $\Delta V_{pol-1}=V_{pol-1}-V_{ini-P-1}$, $\Delta V_{prog-pol-1}=V_{prog-pol-1}-V_{cal}$; since here $V_{prog-pol-1}=V_{cal}$ (that is, $\Delta V_{prog-pol-1}=0$), it is possible to keep $V_{ini-P-1}=0$, because $\Delta V_{pol-1}$ is itself also positive or zero such that $V_{pol-1}$ remains of the same sign as $V_{data-1}$.

Similarly, in the second frame, the potentials of the address electrode $X_D$ successively assume the values $V_{ini-E}=0$, $V_{data-2}$, $V_{ini-P-2}$, $V_{pol-2}$, and the potentials of the control terminal C successively assume the values $V_{cal}$, $V_{prog-data-2}$, $V_{cal}$, $V_{prog-pol-2}$, with $\Delta V_{data-2}=V_{data-2}-V_{ini-E}$, $\Delta V_{prog-data-2}=V_{prog-data-2}-V_{cal}$, $\Delta V_{pol-2}=V_{pol-2}-V_{ini-P-2}$, $\Delta V_{prog-pol-2}=V_{prog-pol-2}-V_{cal}$; since this time $V_{prog-pol-2}<V_{cal}$ (that is, $\Delta V_{prog-pol-1}<0$), it is appropriate for $V_{ini-P-2}=-V_{pol-2}$ so that $V_{ini-P-2}+\Delta V_{pol-2}=V_{pol-2}$ remains positive or zero, that is, of the same sign as $V_{data-2}$.

It is demonstrated that the proportionality constant K(t), that is the coupling constant, between the potential jumps on the control terminal C: $\Delta V_{prog-data-1}$, $\Delta V_{prog-pol-1}$, $\Delta V_{prog-data-2}$ and $\Delta V_{prog-pol-2}$, and the corresponding potential jumps on the address electrode $\Delta V_{data-1}$, $\Delta V_{pol-1}$, $\Delta V_{data-2}$, and $\Delta V_{pol-2}$, that changes over time from the instant t=0 at which said potential jump is applied to the address electrode, is expressed in the form:

$$K(t) = K \times (1 - e^{-\frac{t}{\tau}}),$$

where $K=C_C/(C_C+C_S)$, $C_C$ and $C_S$ here denote the values of the capacitances respectively of the coupling capacitors and of the sustain capacitors, where $\tau=R4\times C_S\times C_C/(C_C+C_S)$, where R4 denotes the electrical resistance of the select switch when it is closed.

To obtain the stabilization of the potentials and to charge the sustain capacitor $C_S$ in an addressing step (step 2 or 5 above), it is preferable for the duration of this step to be at least equal to $5\times\tau$.

Since the transistors of the driver are of amorphous silicon, the value of R4 is normally high, of the order of a hundred or so kiloOhms, which induces a relatively high time constant $\tau$.

More specifically, by taking $C_S=0.5$ pF, $C_C=3$ pF, a simulation using the SPICE software shows that the duration to obtain the stabilization of the potentials after an address signal presenting a voltage jump of 17 V is 3.25 μs.

More specifically, by taking $C_S=0.5$ pF, $C_C=10$ pF, a simulation using the "aimSPICE" software shows that the duration to obtain the stabilization of the potentials after an address signal presenting a voltage jump of 16 V is 4.5 μs. Regarding the stabilization time, these two simulations give more accurate results, although of the same order of magnitude as the above equation.

In order to obtain a coupling constant K that is as close as possible to 1, it is preferable to choose $C_C>>C_S$, which is illustrated by the two simulation examples above.

As FIG. 3 illustrates, $V_{prog-data-2}>>V_{prog-data-1}$, which means that the modulator T2 is much more strongly polarized in the second frame than in the first frame, causing a far greater variation in the trigger threshold voltage of this modulator; consequently, $|V_{prog-pol-2}|>>|V_{prog-pol-1}|$ is chosen so as to compensate for this much greater polarization in the second frame by a depolarization that is also greater. It can therefore be seen that this embodiment of the invention advantageously makes it possible to adapt the value of each depolarization address signal $V_{pol-i}$ of a depolarization period to the value of each display address signal $V_{data-i}$ of the preceding display period so as to best compensate for the drifts in the trigger threshold voltage of the modulators of each driver 1.

A variant of the first embodiment is illustrated in FIG. 2: the display panel is identical to the preceding one, apart from the fact that the clamping switch T3 is suitable to link directly, without passing through the select switch T4, the clamping terminal R to the control terminal C of the circuit 1'.

The panel according to this variant can be controlled as described previously for the main embodiment.

The embodiments described above relate to organic light-emitting diode display panels with active matrix; the invention applies more generally to all sorts of active matrix display panels, in particular to current-controllable emitters or to optical valves.

The invention claimed is:

1. Method of controlling a display panel which comprises:

an array of light emitters or optical valves, an active matrix comprising an array of electrodes for addressing voltage-mode signals, an array of select electrodes, an array of clamping electrodes, at least one reference electrode for addressing, an array of circuits suitable for controlling each of said emitters or valves and each provided with a voltage-mode control terminal suitable for coupling to an address electrode via a first coupling capacitor and via a select switch which are mounted in series, a voltage-mode clamping terminal suitable for connecting to said control terminal via a clamping switch and a second sustain capacitor mounted between said control terminal and said clamping terminal, the clamping terminal being linked to the at least one reference electrode, a control of said select switch being linked to a select electrode and a control of said clamping switch being linked to a clamping electrode, said method comprising emission periods during which a predetermined emission voltage, which presents a first polarity, is applied and sustained at the control terminal of at least one of said array of circuits, wherein the method also comprises depolarization periods during which a predetermined depolarization voltage, which presents a second polarity, opposite to the first polarity, is applied and sustained at the control terminal of the at least one of said array of circuits, and wherein said predetermined emission voltage or predetermined depolarization voltage is applied to the control terminal of the at least one of said array of circuits by capacitive coupling according to the following steps:

a clamping step, during which, said reference electrode is raised to a clamping potential, a select signal is applied to the select electrode that controls the select switch and a clamping signal is applied to the clamping electrode that controls the clamping switch of the at least one of said array of circuits, these signals being suitable for closing said select switch and said clamping switch, and, while said select signal and said clamping signal are being simultaneously applied, an initial voltage signal is applied to the address electrode to which said control terminal is suitable to be coupled, a circuit addressing step, during which, having ended said clamping signal but while sustaining said select signal, after clamping a potential of the control terminal to the clamping potential of said reference electrode has been obtained, and after applying said initial voltage signal, a final voltage signal is applied to said address electrode, this final voltage signal generating a voltage jump on this address electrode which in turn generates a voltage jump on said control terminal that is coupled to said address electrode, the values of said initial voltage signal and of said final voltage signal being adapted to obtain, after said voltage jump on said control terminal, said predetermined emission voltage during the emission periods and said predetermined depolarization voltage during the depolarization periods.

2. Method according to claim 1, wherein, whatever the emission or depolarization period, and polarity of said predetermined emission voltage or of said predetermined depolarization voltage, said initial voltage signal and said final voltage signal are chosen such that both present the same first polarity.

3. Method according to claim 1, wherein said panel comprises an array of light emitters suitable to be powered between at least one base power supply electrode and at least one upper power supply electrode, each of said array of circuits comprises a current modulator comprising a voltage-mode control electrode forming the control terminal and two current-passing electrodes, which are connected between one base power supply electrode and one upper power supply electrode.

4. Method according to claim 3, wherein said current modulator is a transistor comprising a semiconductor layer of amorphous silicon.

5. Method according to claim 3, wherein said emitters are light-emitting diodes.

6. Method of controlling a display panel which comprises:

an array of light emitters or optical valves, an active matrix comprising an array of electrodes for addressing voltage-mode signals, an array of select electrodes, an array of clamping electrodes, at least one reference electrode for addressing, an array of circuits suitable for controlling each of said emitters or valves and each provided with a voltage-mode control terminal suitable for coupling to an address electrode via a first coupling capacitor and via a select switch which are mounted in series, a voltage-mode clamping terminal suitable for connecting to said control terminal via a clamping switch and a second sustain capacitor mounted between said control terminal and said clamping terminal, the clamping terminal being linked to the at least one reference electrode, a control of said select switch being linked to a select electrode and the control of said clamping switch being linked to a clamping electrode, said method comprising emission periods during which a predetermined emission voltage, which presents a first polarity, is applied and sustained at the control terminal of at least one of said array of circuits, wherein the method also comprises depolarization periods during which a predetermined depolarization voltage, which presents a second polarity, opposite to the first polarity, is applied and sustained at the control terminal of the at least one of said array of circuits, and wherein during said emission periods and depolarization periods, a potential that is applied to the reference electrode to which said clamping terminal is linked is the same and is sustained at a constant negative value.

* * * * *